US007189911B2

(12) United States Patent
Isozaki

(10) Patent No.: US 7,189,911 B2
(45) Date of Patent: Mar. 13, 2007

(54) ELECTRONIC MUSICAL APPARATUS HAVING INTERFACE FOR CONNECTING TO COMMUNICATION NETWORK

(75) Inventor: Yoshimasa Isozaki, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/171,110

(22) Filed: Jun. 12, 2002

(65) Prior Publication Data

US 2003/0000368 A1 Jan. 2, 2003

(30) Foreign Application Priority Data

Jun. 13, 2001 (JP) ..... 2001-179001

(51) Int. Cl.
*G10H 7/00* (2006.01)
*G04B 13/00* (2006.01)
*A63H 5/00* (2006.01)

(52) U.S. Cl. ..... 84/609; 84/622

(58) Field of Classification Search ..... 84/600, 84/609, 622, 645, 659
See application file for complete search history.

(56) References Cited

U.S. PATENT DOCUMENTS 5,563,359 A 10/1996 Okamura et al.
5,850,050 A 12/1998 Isozaki et al.
5,892,171 A * 4/1999 Ide ..... 84/622
6,031,175 A 2/2000 Tozuka
6,180,862 B1 * 1/2001 Hirano ..... 84/601
6,184,454 B1 2/2001 Imai et al.
6,353,169 B1 * 3/2002 Juszkiewicz et al. ..... 84/600
6,353,174 B1 * 3/2002 Schmidt et al. ..... 84/609
6,369,310 B1 * 4/2002 Brunson et al. ..... 84/600
6,441,291 B2 * 8/2002 Hasegawa et al. ..... 84/609
2002/0014147 A1 * 2/2002 Motoyama ..... 84/615

FOREIGN PATENT DOCUMENTS

EP 0837451 A 4/1998
EP 0855697 A1 7/1998
JP 09288490 A * 11/1997
JP 09-288490 11/1997
JP 10-124051 5/1998
JP 10124051 A * 5/1998
JP 11224086 A * 8/1999
JP 11-224086 8/1999
WO WO 01/16931 3/2001

OTHER PUBLICATIONS

International Search Report for EP 02012241 dated Jan. 8, 2004, ISA/EPO.
Japanese Office Action dated Apr. 19, 2005.

* cited by examiner

*Primary Examiner*—Jeffrey W Donels
(74) *Attorney, Agent, or Firm*—Harness, Dickey & Pierce, P.L.C.

(57) ABSTRACT

An electronic musical apparatus having an interface for connecting to a communication network comprises: a memory; a receiver that receives, from the communication network via the interface, a first performance setting information used for executing musical performance in accordance with a first performance information on the electronic musical apparatus or the other electronic musical apparatus; a controller that controls the received first performance setting information to store into the memory; an input device that inputs a second performance information; and a musical tone generator that generates a musical tone in accordance with the second performance information and the stored first performance setting information.

23 Claims, 11 Drawing Sheets

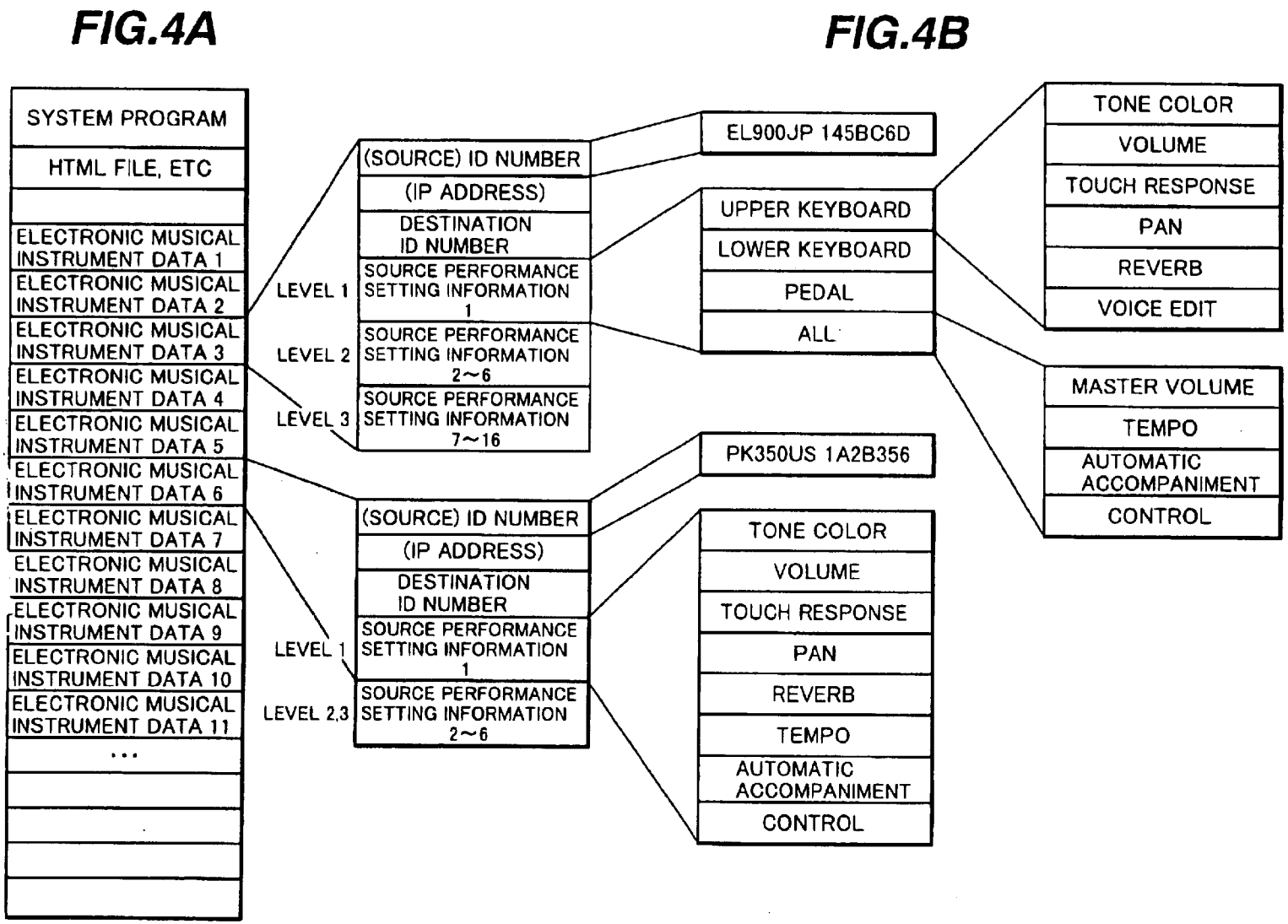
FIG.4A
SYSTEM PROGRAM
HTML FILE, ETC
ELECTRONIC MUSICAL INSTRUMENT DATA 1
ELECTRONIC MUSICAL INSTRUMENT DATA 2
ELECTRONIC MUSICAL INSTRUMENT DATA 3
ELECTRONIC MUSICAL INSTRUMENT DATA 4
ELECTRONIC MUSICAL INSTRUMENT DATA 5
ELECTRONIC MUSICAL INSTRUMENT DATA 6
ELECTRONIC MUSICAL INSTRUMENT DATA 7
ELECTRONIC MUSICAL INSTRUMENT DATA 8
ELECTRONIC MUSICAL INSTRUMENT DATA 9
ELECTRONIC MUSICAL INSTRUMENT DATA 10
ELECTRONIC MUSICAL INSTRUMENT DATA 11
...
LEVEL 1
LEVEL 2
LEVEL 3
LEVEL 1
LEVEL 2,3
(SOURCE) ID NUMBER
(IP ADDRESS)
DESTINATION ID NUMBER
SOURCE PERFORMANCE SETTING INFORMATION 1
SOURCE PERFORMANCE SETTING INFORMATION 2~6
SOURCE PERFORMANCE SETTING INFORMATION 7~16
(SOURCE) ID NUMBER
(IP ADDRESS)
DESTINATION ID NUMBER
SOURCE PERFORMANCE SETTING INFORMATION 1
SOURCE PERFORMANCE SETTING INFORMATION 2~6
FIG.4B
EL900JP 145BC6D
UPPER KEYBOARD
LOWER KEYBOARD
PEDAL
ALL
TONE COLOR
VOLUME
TOUCH RESPONSE
PAN
REVERB
VOICE EDIT
MASTER VOLUME
TEMPO
AUTOMATIC ACCOMPANIMENT
CONTROL
PK350US 1A2B356
TONE COLOR
VOLUME
TOUCH RESPONSE
PAN
REVERB
TEMPO
AUTOMATIC ACCOMPANIMENT
CONTROL

ELECTRONIC MUSICAL APPARATUS HAVING INTERFACE FOR CONNECTING TO COMMUNICATION NETWORK

CROSS REFERENCE TO RELATED APPLICATION

This application is based on Japanese Patent Application No. 2001-179001, filed on Jun. 13, 2001.

BACKGROUND OF THE INVENTION

A) Field of the Invention

The present invention relates to a performance setting information transferable electronic musical apparatus and server, a performance setting information transferring method, and a program. More particularly, the invention relates to a performance setting information transferring system in which performance setting information can be transferred to and from a plurality of electronic musical apparatuses and a server via a communication network such as the Internet. The performance setting information may be called registration data.

B) Description of the Related Art

In an electronic musical apparatus such as an electronic musical instrument, tone color, rhythm, automatic performance, effects and the like are set on the panel of the apparatus and the set information is stored in a storage device. When music is played, the set information is read to produce desired musical tones. Such set and stored information is called performance setting information or simply registration data.

Conventionally, performance setting information is stored in a portable medium such as a floppy disk (FD). A player carries it to the place where music is played. If an electronic musical instrument has a plurality of components, setting these components is complicated and requires a hard work.

SUMMARY OF THE INVENTION

An object of this invention is to provide a performance setting information transferring system capable of properly transferring, when necessary, desired performance setting information (so called registration data) among a plurality of electronic musical apparatuses interconnected by a communication network without any restrictions on places and use times of the apparatuses.

According to one aspect of the present invention, there is provided an electronic musical apparatus having an interface for connecting to a communication network, comprising: a memory; a receiver that receives, from the communication network via the interface, a first performance setting information used for executing musical performance in accordance with a first performance information on the electronic musical apparatus or the other electronic musical apparatus; a controller that controls the received first performance setting information to store into the memory; an input device that inputs a second performance information; and a musical tone generator that generates a musical tone in accordance with the second performance information and the stored first performance setting information.

According to another aspect of the present invention, there is provided a server connecting to a plurality of electronic musical apparatuses via a communication network, each electronic musical apparatus generating a musical tone in accordance with performance information and performance setting information set for executing musical performance and having an ID number, the server comprising: a memory that stores the performance setting information transmitted from the plurality of electronic musical apparatuses together with the ID number corresponding to the performance setting information; a receiver that receives a request for the performance setting information corresponding to a specified ID number from one electronic musical apparatus; and a replying device that reads, in response to the request, the performance setting information corresponding to the specified ID from the memory and replies the read performance setting information to said one electronic musical apparatus.

Performance setting information called registration information is stored in storage means 13, 14 of an electronic musical apparatus 1. Tone signal generating means 11, 18, 24 generates a tone signal in accordance with performance information (event information) and performance setting information. Interface means (I/F 19 or I/F 20+another communication terminal) connects a communication network 2 such as the Internet for data transfer. Control means 11 to 13 controls to access via the interface means 19, 20 to the communication network, to acquire performance setting information of another electronic musical apparatus connected to the communication network 2, to store the acquired performance setting information in the storage means 13, 14, and to make the tone signal generating means 11, 18 generate a tone signal in accordance with the performance information and the stored performance setting information.

The performance setting information (registration information) of another electronic musical apparatus such as an electronic musical instrument is acquired via the communication network 2 such as the Internet, and a desired tone signal can be generated by using the acquired performance setting information as the tone signal control parameters. If two electronic musical apparatuses are connected by the communication network 2, one electronic musical apparatus can acquire the performance setting information of the other electronic musical apparatus without any restrictions on places and performance time. The performance setting information of both the electronic musical apparatuses can be used in various situations.

For example, the performance setting information of a master electronic musical apparatus set up in a home or studio may be acquired at a remote place such as the stage of a concert hall via the Internet or the like to obtain the setting state of the master electronic musical apparatus. Conversely, the performance setting information newly edited and set at the remote place such as a concert hall may be transmitted to a home or studio to renew the performance setting information.

In a remote lessen of music via the network, an electronic musical apparatus of a teacher is used as a master (transmission side) and an electronic musical apparatus of a student is used as a slave (reception side). Registration of the electronic musical apparatus of the teacher can be set to the electronic musical apparatus of the student. Even a novice of an electronic musical apparatus can be taught efficiently. Such efficient teaching can be applied also to a music teaching system connecting the electronic musical instrument of a teacher to the electronic musical apparatus of a student.

If the teaching is to be applied to a remote lessen system having two electronic musical apparatuses always connected via the communication network 2 such as the Internet, it is preferable to connect two electronic musical apparatuses in a point to point (P to P) mode without involvement of a server.

The electronic musical apparatus acquires the performance setting information of another electronic musical apparatus via a server 3 connected on the communication network 2 such as the Internet under the control of the control means 11 to 13. A plurality of electronic musical apparatuses transfer registration information under the control of the control means of the server. Therefore, two electronic musical apparatuses between which performance setting information is transferred are not required to be always connected to the communication network 2 such as the Internet. Loads of CPU can therefore be reduced. The performance setting information of another electronic musical apparatus can be acquired via the server 3 even if the other electronic musical apparatus is not turned on and connected to the communication network 2.

The electronic musical apparatus is provided with an information acquire switch (hot communication switch SS) to be used for acquiring the performance setting information. In response to an operation of the information acquire switch SS, the communication network 2 is accessed under the control of the control means 11 to 13 to acquire the performance setting information of another electronic musical apparatus. The information acquire switch SS functions also as a button for setting the setup state same as that of another predetermined electronic musical apparatus. Even if the information acquire switches SS are operated by a plurality of electronic musical apparatuses, the same setup state can be set to all the electronic musical apparatus at the same time. In the P to P mode, simply by depressing the information acquire switch SS, the latest performance setting information of another electronic musical apparatus can be acquired at any time and the same latest setup state can be renewed at a plurality of electronic musical apparatuses.

In the electronic musical apparatus, the control means 11 to 13 can set update time data representative of an update interval of performance setting information. The performance setting information of another electronic musical apparatus can be automatically acquired at the interval of the set update time data. Setting suitable for a communication network or use environment can be realized. For example, the interval of the update time data is shortened for a remote lessen.

The control means 11 to 13 of the electronic musical apparatus can select either a master mode or a slave mode. When the slave mode is selected, the electronic musical apparatus can acquire and store performance setting information of another electronic apparatus, and when the master mode is selected, performance setting information of the electronic musical apparatus is transmitted to the server 3 to allow another electronic musical apparatus to use it.

The server 3 is connected via the communication network 2 to a plurality of electronic musical apparatuses 1 capable of generating a tone signal in accordance with performance setting information. The storage means 34 stores performance setting information received from the plurality of electronic musical apparatuses 1 in correspondence with ID numbers of the electronic musical apparatuses. In response to an access from an electronic musical apparatus and a request for acquiring performance setting information of another electronic musical apparatus corresponding to a designated ID number, the requested performance setting information is read from the storage means 34 and transmitted back to the electronic musical apparatus.

It is possible to reliably run a system capable of transferring performance setting information between a plurality of electronic musical apparatuses 1 by using the storage means 34 of the server 3 even if two electronic musical apparatuses 1 for transferring the performance setting information are not maintained to be always connected to the communication network 2 such as the Internet. The server 3 can supply the performance setting information of an electronic musical apparatus even if the electronic musical apparatus is not turned on and connected to the communication network.

In response to an access from an electronic musical apparatus 1 and a request for searching a destination from which performance setting information can be acquired, list information of electronic musical apparatuses from which the performance setting information can be acquired is transmitted back to the electronic musical apparatus. An ID number of the electronic musical apparatus 1 is stored in the storage means 34 in correspondence with an ID number of another electronic musical apparatus selected from the list information by the electronic musical apparatus 1. In response to a request for acquiring the performance setting information from the other electronic musical apparatus, the performance setting information of the selected other electronic musical apparatus having the ID number is read from the storage means 34 and transmitted back to the electronic musical apparatus. Accordingly, a system for transferring performance setting information between remote electronic musical apparatuses via the communication network can flexibly deal with a new electronic musical apparatus and can run smoothly.

BRIEF DESCRIPTION OF THE DRAWINGS

FIGS. 4A and 4B are diagrams showing the contents of a storage device of the server according to the embodiment.

DESCRIPTION OF THE PREFERRED EMBODIMENTS

Figure 1:
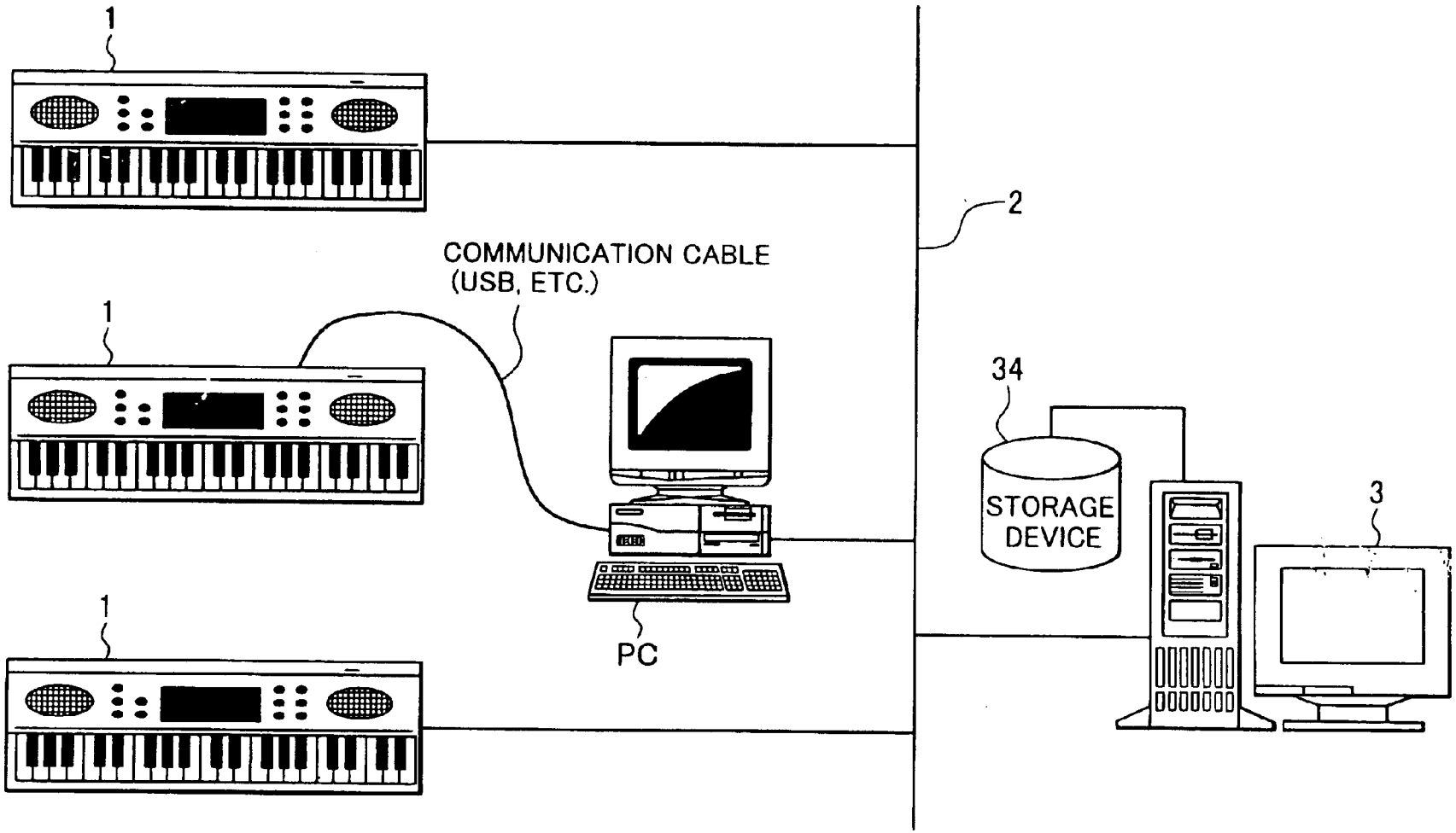
FIG. 1 is a diagram briefly showing the whole system capable of transferring performance setting information according to an embodiment of the invention.

FIG. 1 is a diagram briefly showing the whole system capable of transferring performance setting information according to an embodiment of the invention. A plurality of electronic musical apparatuses 1 function as communication terminals having a communication function. The electronic musical apparatus 1 can communicate with a server 3 via a public communication network 2 such as the Internet. The server 3 has a storage device 34 for storing performance setting information, which is also called registration data, of the electronic musical apparatus 1 such as an electronic musical instrument. Each electronic musical apparatus 1 can be used both a master and a slave.

The electronic musical apparatuses 1 shown in FIG. 1 at the upper and lower positions have an interface such as a modem, a terminal adapter and a LAN card. These electronic musical apparatuses 1 can directly access the server 3 on the communication network 2.

The electronic musical apparatus 1 shown in FIG. 1 at the middle position is connected to a personal computer (PC) or portable communication terminal via which the communication network 2 is accessed. In this case, PC or portable communication terminal is connected via a cable such as a USB cable to the electronic musical apparatus, and executes a program for accessing the server 3 in response to an instruction from the electronic musical apparatus.

The electronic musical apparatus 1 communicates with the server 3 via the communication network 2. The server 3 stores performance setting information received from the electronic musical apparatuses 1 as well as the ID numbers of the apparatuses in a storage device 34. When one electronic musical apparatus 1 requests for the performance setting information of another electronic musical apparatus 1 having the designated ID number, the server 3 reads the requested performance setting information from the storage device 34 and sends it back to the requested electronic musical apparatus. In accordance with the received performance setting information, the other electronic musical apparatus can generate musical tone signals. Desired performance setting information can be acquired properly when necessary without any restrictions on places and use times of the electronic musical apparatuses.

Figure 2:
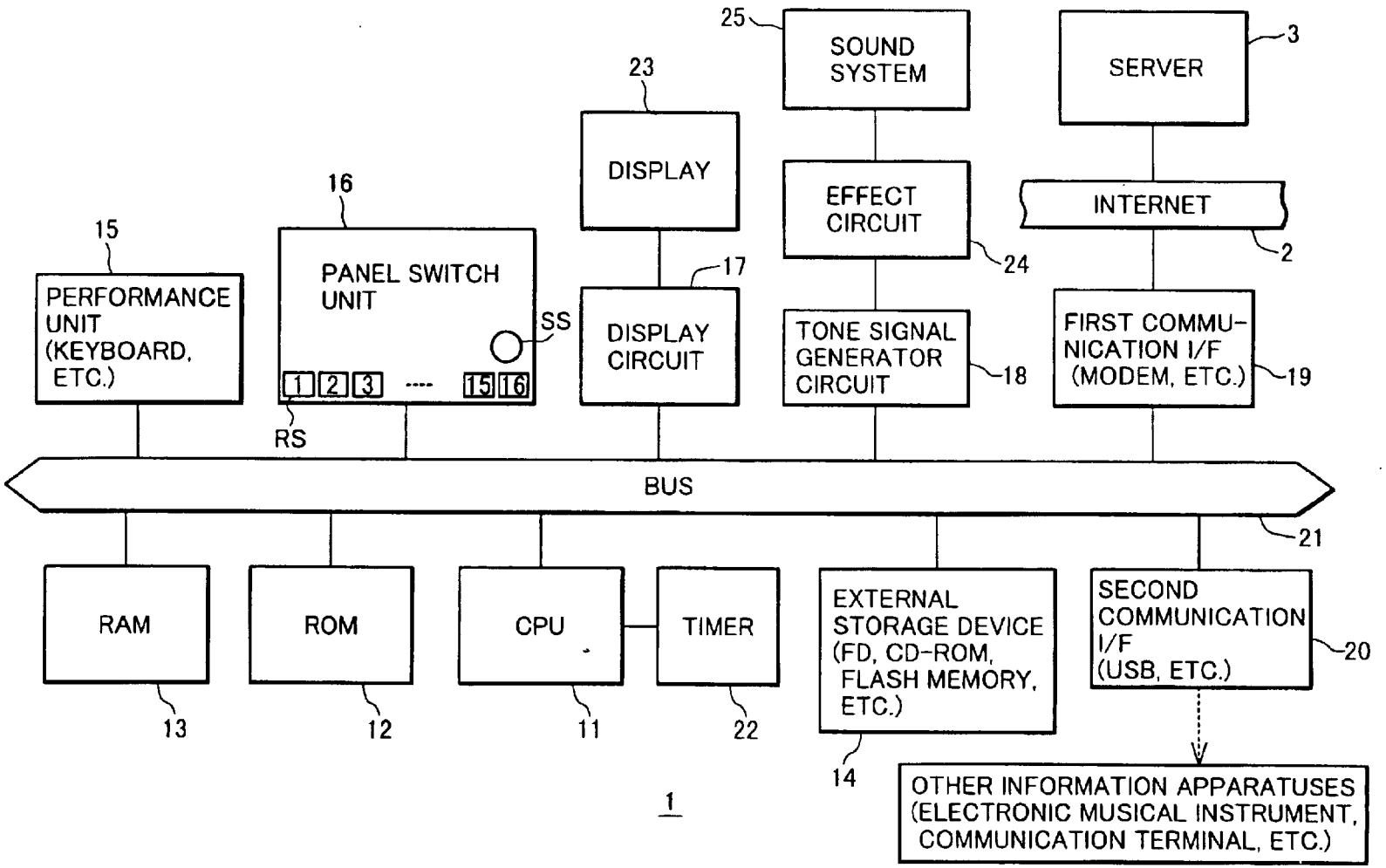
FIG. 2 is a block diagram showing the hardware structure of an electronic musical apparatus according to the embodiment.

FIG. 2 is a block diagram showing the hardware structure of an electronic musical apparatus according to the embodiment. As the electronic musical apparatus, an electronic musical instrument is used. The electronic musical instrument has a communication terminal function of accessing the communication network such as the Internet. The electronic musical instrument has a central processing unit (CPU) 11, a read only memory (ROM) 12, a random access memory (RAM) 13, an external storage device 14, a performance unit 15 having a performance operator such as a keyboard, a panel switch unit 16 having various panel operators, a display circuit 17, a tone signal generator circuit 18, first and second communication interfaces (I/F) 19 and 20, and the like, respectively interconnected by a bus 21.

CPU 11 performs mainly various processes for musical performance in accordance with software programs and synchronously with a timer 22. These processes include a process of controlling the generation of musical tone signals in accordance with performance information and the transfer control of performance setting information (registration data). ROM 12 stores predetermined programs for performing such processes and various control data.

RAM 13 stores data and parameters necessary for various processes and is used for a working area for temporarily storing various data under processing. For example, RAM 13 has memory areas such as various registers and registration memories 1 to 16.

The external storage device 14 may be a hard disk (HD), a flexible disk (floppy disk) (FD), a compact disc read only memory (CD-ROM), or a portable storage medium such as a flash memory. The external storage device 14 stores various data related to musical tone signal generation control and performance setting information transfer, such as performance information and performance setting information (registration data), and also stores processed result data.

The performance unit 15 has: main performance operators (pitch designating operators) such as an upper keyboard, a lower keyboard and a pedal keyboard; auxiliary performance operators such as a modulation wheel; and a performance detector circuit. The performance detector circuit detects an operation of each operator and inputs it to the electronic musical instrument system as one piece of performance information. This performance information is used for generating a musical tone signal which matches performance setting information. This performance information as well as the performance setting information can be stored in a predetermined memory area of the external storage device 14. Further, performance information may be, for example, data based on musical instrumental digital interface (MIDI) standard, and the MIDI data consists of event data including sequence of note-on event, note-off event, program-change event, control-change event etc.

The panel switch unit 16 has: panel operators such as operation switches; and a panel operation detector circuit. The panel operators are called "panel switches" and used for setting various control parameters for playing an electronic musical instrument. A setting operation of each panel switch is detected by the panel operation detector circuit to perform various controls of the electronic musical instrument, such as the generation of musical tones. The display circuit 17 has a display 23 for displaying the set/control state and performance state of the electronic musical instrument 1.

The control parameters include performance parameters for controlling or adding tone color, touch response, volume, tempo, rhythm, automatic performance, effects and the like to the musical tones generated in accordance with the performance information. The setting state of each performance parameter is expressed by the performance setting information (registration data).

The panel switch unit 16 also has: a number of performance parameter setting switches (not shown) for setting various performance parameters; memory switches (not shown) to be used for storing the performance setting information representing the performance parameter setting contents in the registration memories 1 to 16 of RAM 13; registration switches RS 1 to 16 for the registration memories 1 to 16; and a hot communication switch SS to be used for transferring the performance setting information to and from the server 3 or another electronic musical apparatus connected to the Internet. In the example shown in FIG. 2, there are sixteen registration memories 1 to 16 and corresponding sixteen registration switches RS 1 to 16.

After the performance parameter is set by the performance parameter setting switch (this operation is called "panel-set"), the registration switch RS is operated while the memory switch is depressed at the same time-to store the performance setting information representing the panel-set performance parameter in the registration memory corresponding to the operated registration switch RS. The performance setting information stored in the registration memories 1 to 16 can be saved in the corresponding memory area of the external storage device 14 by operating an unrepresented save switch.

While the electronic musical instrument 1 is played, the performance setting information panel-set or read from the external storage device 14 is loaded in the registration memories 1 to 16. When the registration switch RS 1 to 16 is operated, the performance setting information corresponding to the operated registration switch RS is called and used for generating a musical tone signal together with the performance information. The call order of the performance setting information may be preset so that the performance setting information stored in the registration memories 1 to 16 can be called in the preset order each time an unrepresented foot switch is operated.

The hot communication switch SS is a panel switch to be used for entering a "hot communication mode" allowing the electronic musical apparatus 1 to transfer the performance setting information to and from the server 3 or another electronic musical apparatus. In this hot communication mode, if the operation state of the hot communication switch SS is maintained for a predetermined time (e.g., two seconds), the conditions of the hot communication mode can be set or altered.

While the hot communication mode conditions are set, if an instruction or data is entered by using the panel switch on the mode setting window displayed on the display 23, the following conditions (1) to (5) can be set additionally:

(1) A master mode or a slave mode to be selected with a cursor (arrow) key;

(2) An IP address of the server to be input to a predetermined box of the window with a ten-key or character key;

(3) A one-shot mode or a continuous mode to be selected with a cursor (arrow) key:

(4) An update time interval in the continuous mode to be input to a predetermined box of the window with a ten-key or character key; and (5) A hot communication level 1, 2, or 3 to be input to a predetermined box of the widow with a number key or to be set by clicking a predetermined button with a cursor (arrow) key.

The tone signal generator circuit 18 is connected to an effect circuit 24 including a DSP and the like. The effect circuit 24 is connected to a sound system including amplifiers, speakers and the like. A musical tone signal generator constituted of the tone signal generator circuit 18 and effect circuit 24 generates musical tone signals in accordance with the performance information supplied from the performance unit 15, external storage device 14 or second I/F 20 and the performance setting information read from RAM 13 and supplied from the panel switch unit 16, external storage device 14 or I/F 19 or 20. Music sounds corresponding to the musical tone signals are reproduced from the sound system 25.

The first communication I/F 19 is used for connecting the electronic musical apparatus 1 to another apparatus on the Internet 2. For example, various information including the performance setting information of another electronic musical apparatus can be stored in the external storage device via the server 3 and Internet.

The second communication I/F 20 is used for connecting the electronic musical apparatus 1 to another electronic musical apparatus or communication terminal. For example, by using a USB interface or the like as the second communication interface I/F 20, various performance related data and programs can be transferred to and from another information processing apparatus such as a PC, or by using the second communication I/F 20 as a substitute for the first communication I/F 19, the Internet 2 can be accessed via another PC or portable communication terminal having a communication function. By using a MIDI interface or the like as the second communication I/F 20, various performance information and control parameters can be transferred to and from another electronic musical apparatus.

Figure 3:
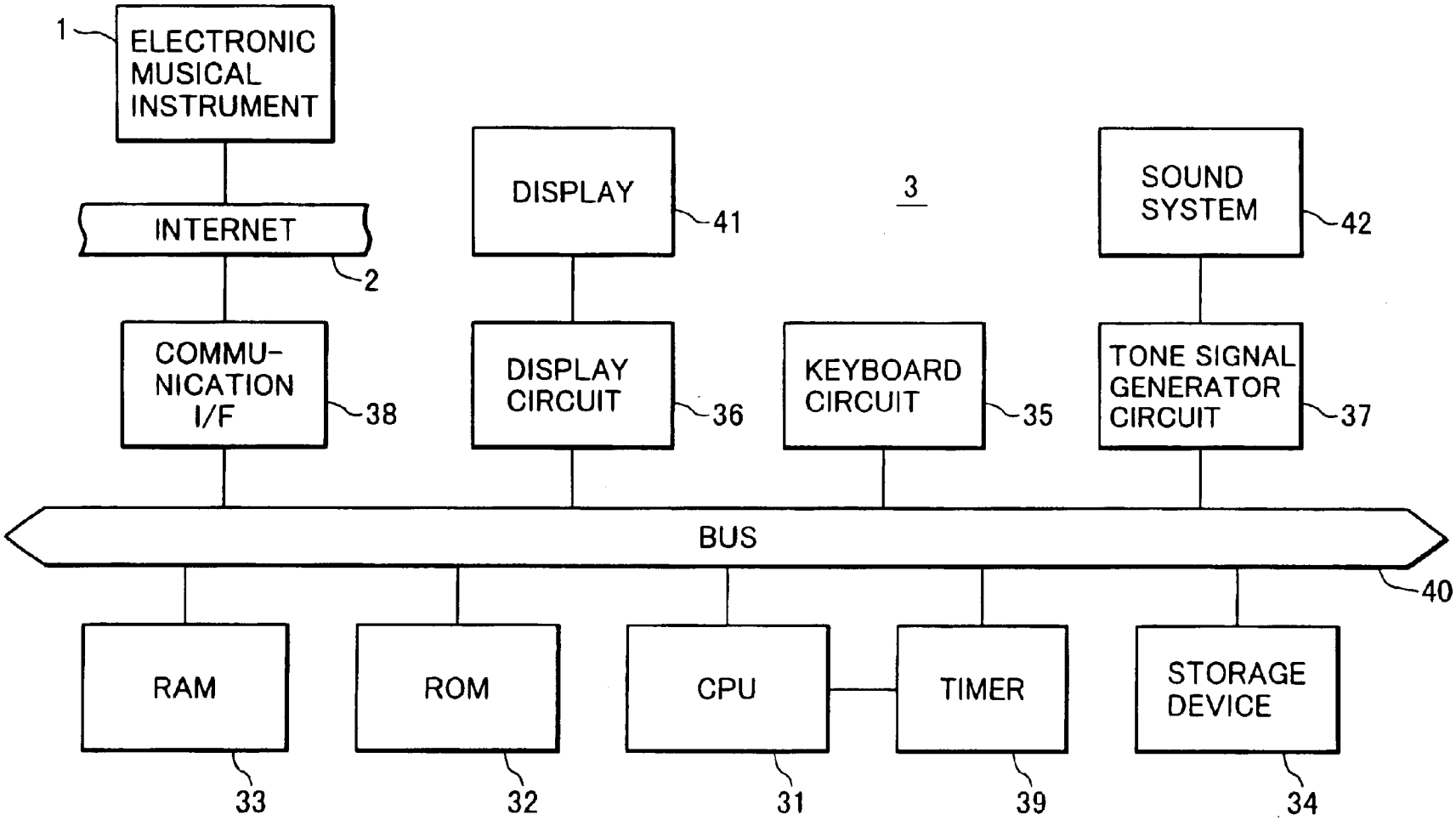
FIG. 3 is a block diagram showing the hardware structure of a server according to the embodiment.

FIG. 3 is a block diagram showing the hardware structure of the server according to the embodiment. The server is configured like a general server computer. In this embodiment, the server 3 has a CPU 31, a ROM 32, a RAM 33, an external storage device 34, a keyboard circuit 35, a display circuit 36, a tone signal generator circuit 37, a communication I/F 38 and the like respectively interconnected by a bus 40.

CPU 31 performs various controls, particularly a process of transferring the performance setting information (registration data) in accordance with predetermined software programs and synchronously with a timer 39. ROM 32 stores predetermined control programs for performing controls and processes. RAM 33 stores data and parameters necessary for various processes and is used for a working area for temporarily storing various data and the like under processing.

The external storage device 34 may be HD, CD-ROM, FD or the like. The external storage device 34 stores various data related to the transfer of performance setting information, and when necessary stores process result data. For example, the external storage device 34 stores a system program for dealing with an access from each electronic musical apparatus 1, HTML information and ID number information of each electronic musical apparatus. In correspondence with ID number information, the external storage device 34 also stores performance setting information transmitted from a source (an electronic musical apparatus) in the master mode and ID number information of a destination (an electronic musical apparatus) which acquires the performance setting information in the slave mode.

The keyboard circuit 35 enters various inputs necessary for the control of the server, by using a panel operator such as a keyboard and a mouse. The display circuit 36 is connected to a display 41, and the tone signal generator circuit 37 is connected to a sound system 42. The communication I/F 38 can communicate with a plurality of electronic musical apparatuses 1 via the communication network 2 such as the Internet.

In this system, the electronic musical apparatus 1 as a terminal equipment uses an electronic musical instrument having performance operators such as a keyboard. Other electronic musical apparatuses different from a keyboard type electronic musical instrument may also be used if they have a communication function of communicating with the communication network such as the Internet or if they can communicate with the communication network via a communication means. Such electronic musical apparatuses may be not only a non-keyboard type electronic musical instrument but also an electronic musical instrument having no performance operator such as a tone generator and a sequencer, a PC having the functions same as those of an electronic musical instrument, a game machine, a karaoke machine, a portable communication terminal equipped with a musical performance function, and the like.

In this embodiment, the performance setting information can be transferred by accessing the server from an electronic musical apparatus. FIGS. 4A and 4B and FIGS. 5A and 5B show examples of the contents stored in RAM of the electronic musical apparatus and in the storage device of the server.

As shown in FIG. 4A, the contents stored in the storage device 34 of the server 3 are a system program, HTML files and a large amount of electronic musical instrument data 1, 2, 3, . . . . The detailed contents of the electronic musical instrument data are shown in FIG. 4B. As shown in the left of FIG. 4B, the electronic musical instrument data includes: an ID number (source ID number) for identifying the electronic musical instrument (source) which set the performance setting information; an ID number or numbers (destination ID number or numbers) for identifying the destination (electronic music instrument) of the performance setting information; performance setting information (source performance setting information) 1, 2, 3, . . . set by the source; and if necessary the source IP address.

The source performance setting information is prepared as many as the number of information pieces which change with the type of an electronic musical instrument, and can be ranked in accordance with the hot communication level (also simply called a "level"). For example, in correspondence with the number of registration memories or switches of each electronic musical instrument, one instrument type can store sixteen pieces of performance setting information 1 to 16 at the maximum, and another instrument type can store six pieces of performance setting information 1 to 6 at the maximum. The performance setting information 1 to 16 and performance setting information 1 to 6 are ranked in the order of the information number. The performance setting information 1 is ranked to the hot communication level 1 (level 1), the performance setting information 1 to 6 is ranked to the hot communication level 2 (level 2), and the performance setting information 1 to 16 is ranked to the hot communication level 3 (level 3).

As shown in the middle of FIG. 4B, the details of the source ID number and source performance setting information are given by way of examples. In these examples, the upper seven alphanumerical symbols identify the type of the electronic musical instrument, and the lower seven alphanumerical symbols identify the user. For example, the upper seven symbols "EL900JP" of the source ID number in the electronic musical instrument data 3 shown in FIG. 4A indicate that the source instrument which set the performance setting information is an "electronic organ" having three keyboards (upper keyboard, lower keyboard and pedal keyboard). Each and all of the three keyboards have classified registrations of performance parameters.

The upper seven symbols "PK350US" of the source ID number in the electronic musical instrument data 6 shown in FIG. 4A indicate that the source instrument is a "portable keyboard" having one keyboard. This keyboard has no classified registrations. As shown in the lower middle of FIG. 4B, the source performance setting information contains performance parameters such as tone color, volume, touch response, pan, reverb, tempo, automatic accompaniment, and control (assignment setting of auxiliary performance operators such as joy stick, modulation wheel and expression pedal).

As shown in the right of FIG. 4B, the details of the performance parameters of each or all of the keyboards of the three-keyboard type electronic musical instrument (electronic organ) are given by way of examples. The upper keyboard registration has performance parameters such as tone color, volume, touch response, pan, reverb and voice edit. The lower and pedal keyboards have similar performance parameters. The performance parameters for all keyboards include master volume (total volume), tempo, automatic accompaniment and control.

Figure 5A:
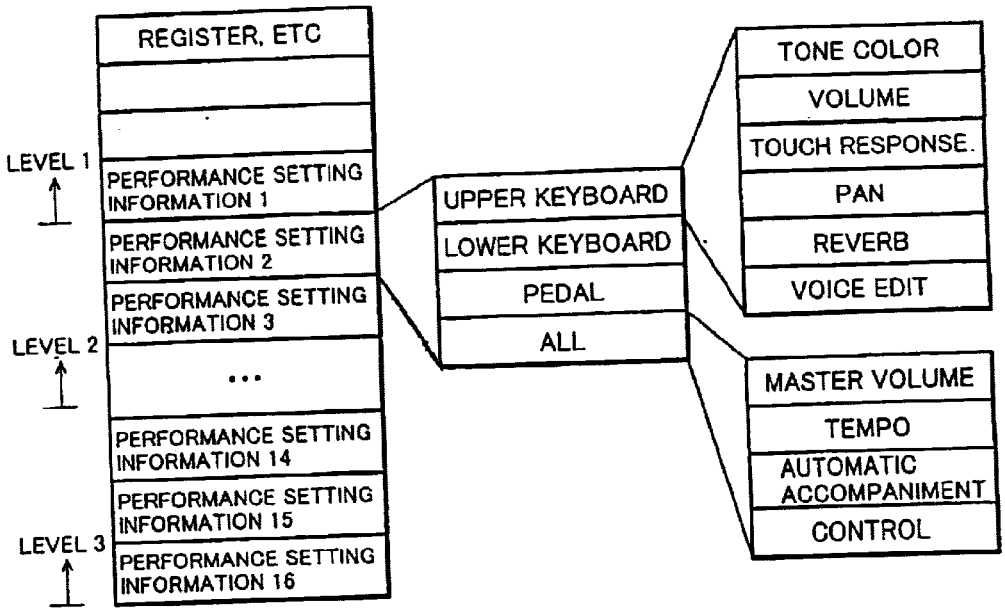
FIGS. 5A and 5B are diagrams showing the contents of a storage device of an electronic musical apparatus according to the embodiment.
Figure 5B:
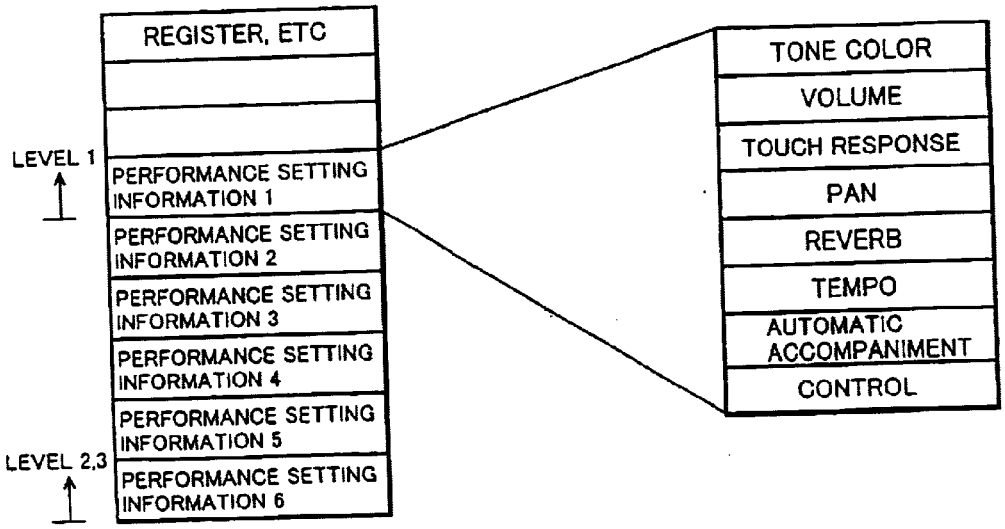
Figure 6:
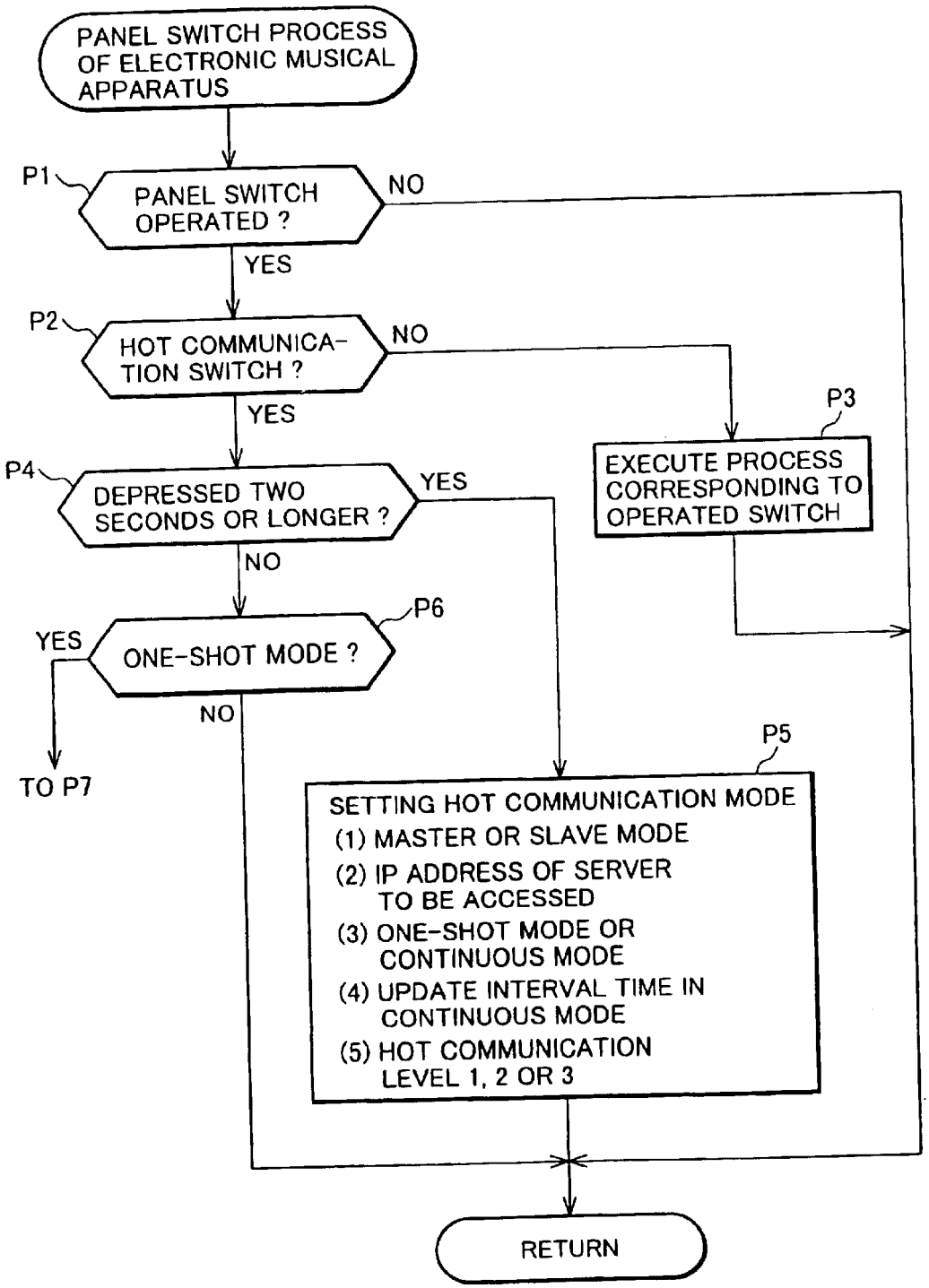
FIGS. 6 and 7 are a flow chart illustrating a panel switch process to be executed by an electronic musical apparatus according to the embodiment.
Figure 7:
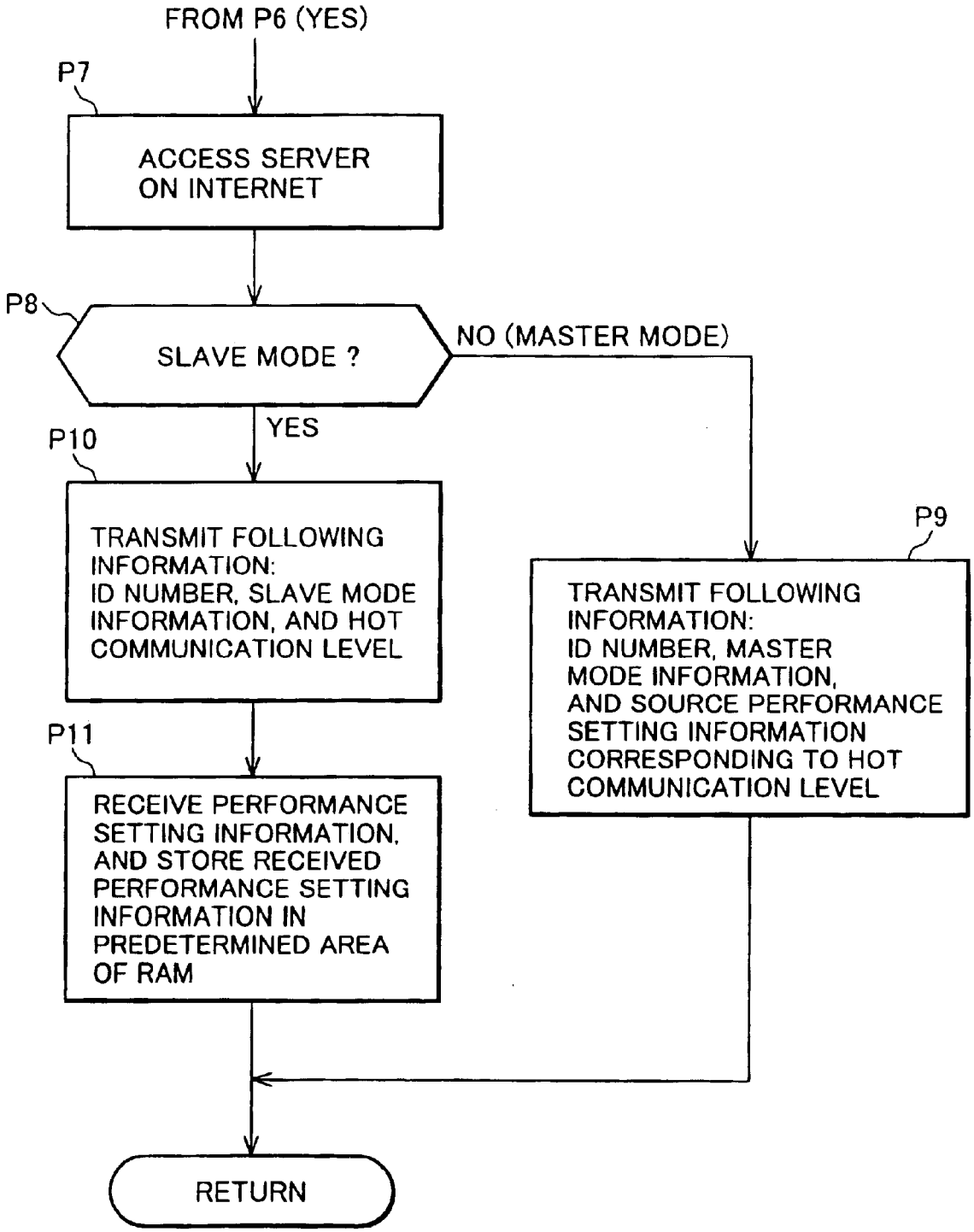

As shown in the left of FIGS. 5A and 5B, RAM 13 of the electronic musical apparatus 1 stores registers and a plurality of pieces of performance setting information. The contents of the performance setting information change with the type of each electronic musical apparatus. For example, as shown in FIG. 5A the three-keyboard type electronic musical instrument of "EL900JP" has the contents of the performance setting information same as the source performance setting information of the "electronic musical instrument data 3" described with reference to FIG. 4B. As shown in FIG. 5B, the one-keyboard type "portable keyboard" of "PK350US" has the contents of the performance setting information same as the source performance setting information of the "electronic musical instrument data 6".

FIGS. 6 to 9 are flow charts illustrating the operation of the electronic musical apparatus according to the embodiment. A three-keyboard type electronic musical instrument (electronic organ) is used as the electronic musical apparatus. First, with reference to the flow chart shown in FIGS. 6 and 7, a panel switch process to be executed by the electronic musical instrument will be described.

This panel switch process starts when the panel switch 16 is operated in an unrepresented main process.

At Step P1 it is checked whether the panel switch 16 is operated. If not, this panel switch process is terminated immediately to return to the main process, whereas if operated, the flow advances to Step P2.

At Step P2 it is checked whether the operated panel switch is the hot communication switch SS. If not, at Step P3 the process assigned to the operated panel switch is executed to terminate the panel switch process.

If the operated panel switch is the hot communication switch SS, the flow advances from Step P2 to Step P4 whereat it is checked whether the hot communication switch SS continues to be depressed for a predetermined time (e.g., two seconds) or longer. If the hot communication switch SS continues to be depressed for the predetermined time or longer, at Step P5 the hot communication mode can be set. After the process at Step P5 is completed, the panel switch process is terminated to return to the main process.

In the hot communication mode setting state at Step P5, by operating the panel switch 16 and by referring to the hot communication mode setting window (not shown) displayed on the display 23, the following conditions (1) to (5) can be set as described earlier: (1) a master mode or slave mode (with a cursor (arrow) key); (2) an IP address of the server (with a number key or character key); (3) a one-shot mode or continuous mode (with a cursor (arrow) key): (4) an update time interval in the continuous mode (with a number key or character key): and (5) a hot communication level 1, 2, or 3 (with a number key or cursor (arrow) key).

In the master mode (1), the electronic musical apparatus becomes a supply side (transmitter) of performance setting information, and in the slave mode (1), the electronic musical apparatus becomes an acquisition side (receiver) of the performance setting information. In the one-shot mode (3), each time the hot communication switch SS is operated, the electronic musical apparatus accesses the server 3 to transmit the performance setting information in the master mode or acquire the performance setting information in the slave mode. In the continuous mode (3), an operation similar to the one-shot mode is performed each time the "update time interval in the continuous mode" set at (4) lapses.

The "hot communication level" (5) is a level for setting the number of pieces of the performance setting information to be transferred in the hot communication mode. An electronic musical apparatus can set and store a plurality of pieces of performance setting information in accordance with music programs to be played. For example, the electronic organ is provided with sixteen pieces of the performance setting information 1 to 16, and the portable keyboard is provided with six pieces of the performance setting information 1 to 6. If all pieces of the performance setting information are transferred in all cases, the data amount is large and it takes a long time to transfer the data. In order to avoid this, for example, as shown in Table 1, the performance setting information as many as the number of pieces corresponding to the set hot communication level 1, 2, or 3 is transferred.

TABLE 1

| Hot communication Level | Electronic organ | Electronic piano | Portable keyboard |
|---|---|---|---|
| Level 1 | Performance setting information 1 | Performance setting information 1 | Performance setting information 1 |
| Level 2 | Performance setting information 1 to 6 | Performance setting information 1 to 6 | Performance setting information 1 to 6 |
| Level 3 | Performance setting information 1 to 16 | Performance setting information 1 to 10 | Performance setting information 1 to 6 |

If it is judged at Step P4 that the operation time of the hot communication switch SS is shorter than the predetermined time (e.g., two seconds) and the mode is the hot communication mode, then it is checked at Step P6 whether the mode is the one-shot mode. If NO, i.e., if the mode is not the one-shot mode but the continuous mode, the panel switch process is terminated to return to the main process. If YES, i.e., if the mode is the one-shot mode, the flow advances to Step P7 (FIG. 7) whereat the electronic musical apparatus accesses the server 3 on the Internet 2 to thereafter advance to Step P8.

At Step P8 it is checked whether the present mode is the slave mode. If NO, i.e., if the present mode is not the slave mode but the master mode, then at Step P9 the ID number of the electronic musical apparatus 1, information indicating the master mode and the performance setting information of the electronic musical apparatus 1 corresponding to the hot communication level are transmitted to the server 3 to thereafter terminate the panel switch process and return to the main process.

If the present mode is the slave mode, the flow advances from Step P8 to Step P10 whereat the ID number of the electronic musical apparatus 1, information indicating the slave mode and the hot communication level are transmitted to the server 3. At the next Step P11, the electronic musical apparatus receives the performance setting information from the server 3 and stores it in the predetermined area (e.g., registration memory area) of RAM 13 to thereafter terminate the panel switch process and return to the main process.

Figure 8:
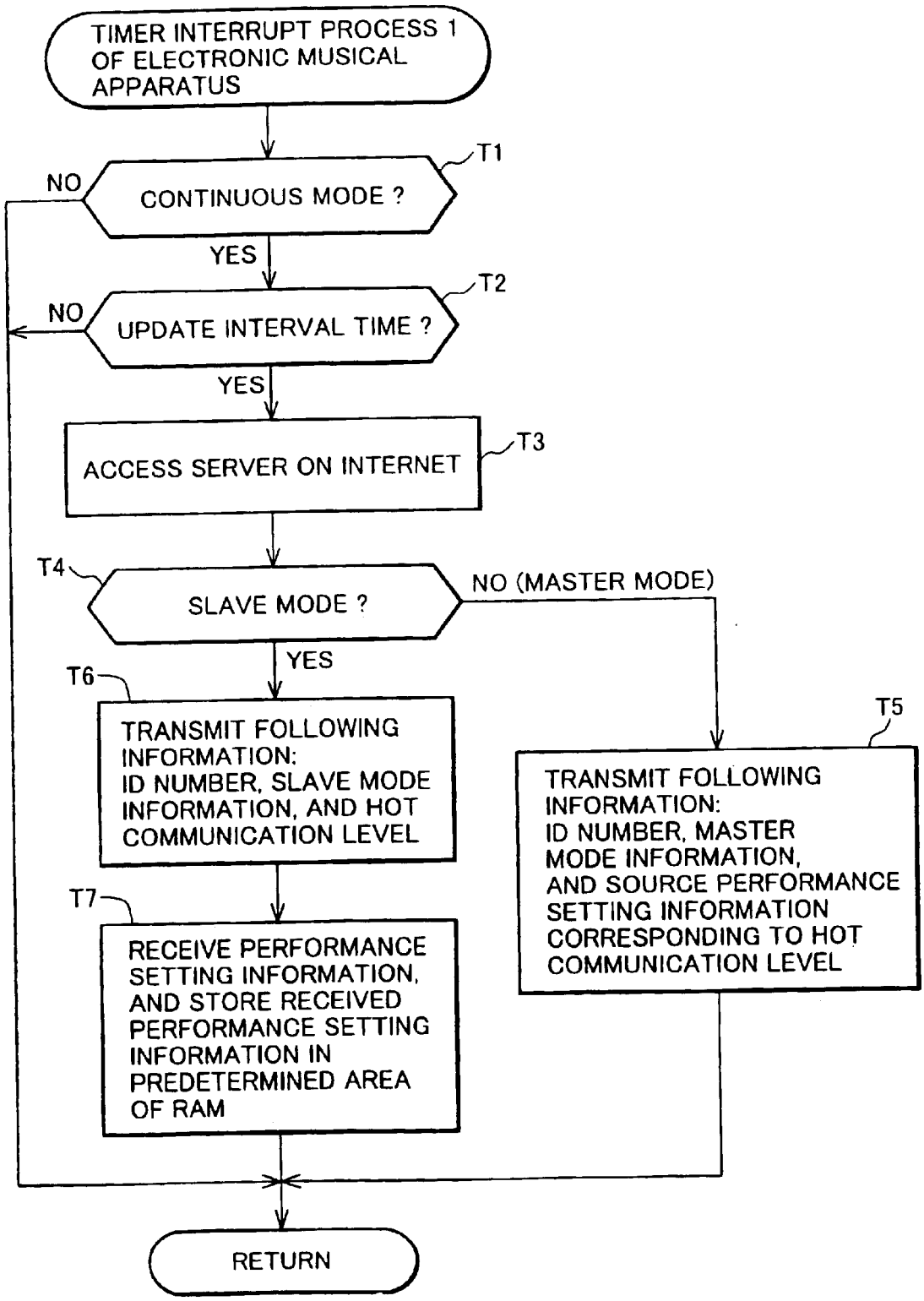
FIG. 8 is a flow chart illustrating a timer interrupt process (continuous mode process) to be executed by an electronic musical apparatus according to the embodiment.

An electronic musical apparatus timer interrupt process 1 shown in FIG. 8 is also called a continuous mode process which is activated at a time interval sufficiently shorter than the update time interval in the continuous mode which can be set at Step P5 of the panel switch process. In this continuous mode process, if the conditions of the hot communication mode are in the "continuous mode", the continuous mode process similar to the processes at Steps P7 to P11 in the one-shot mode is repetitively executed at a predetermined update time interval.

At Step T1 it is checked whether the present mode is the continuous mode and at Step T2 it is checked whether the present time is the update time. If one of Steps T1 and T2 is negated (NO), the timer interrupt process 1 is immediately terminated to return to the main process. If both Steps T1 and T2 are asserted (YES), then at Step T3 the server 3 on the Internet is accessed to thereafter advance to Step T4.

If it is judged at Step T4 that the present mode is the master mode (NO), then at Step T5 the ID number of the electronic musical apparatus 1, information indicating the master mode and the performance setting information of the electronic musical apparatus 1 corresponding to the hot communication level are transmitted to the server 3 to thereafter terminate the timer interrupt process and return to the main process.

If it is judged at Step T4 that the present mode is the slave mode, then at Step T6 the ID number of the electronic musical apparatus 1, information indicating the slave mode and the hot communication level are transmitted to the server 3. At the next Step T7, the electronic musical apparatus receives the performance setting information from the server 3 and stores it in the predetermined area of RAM 13 to thereafter terminate the timer interrupt process and return to the main process.

Figure 9:
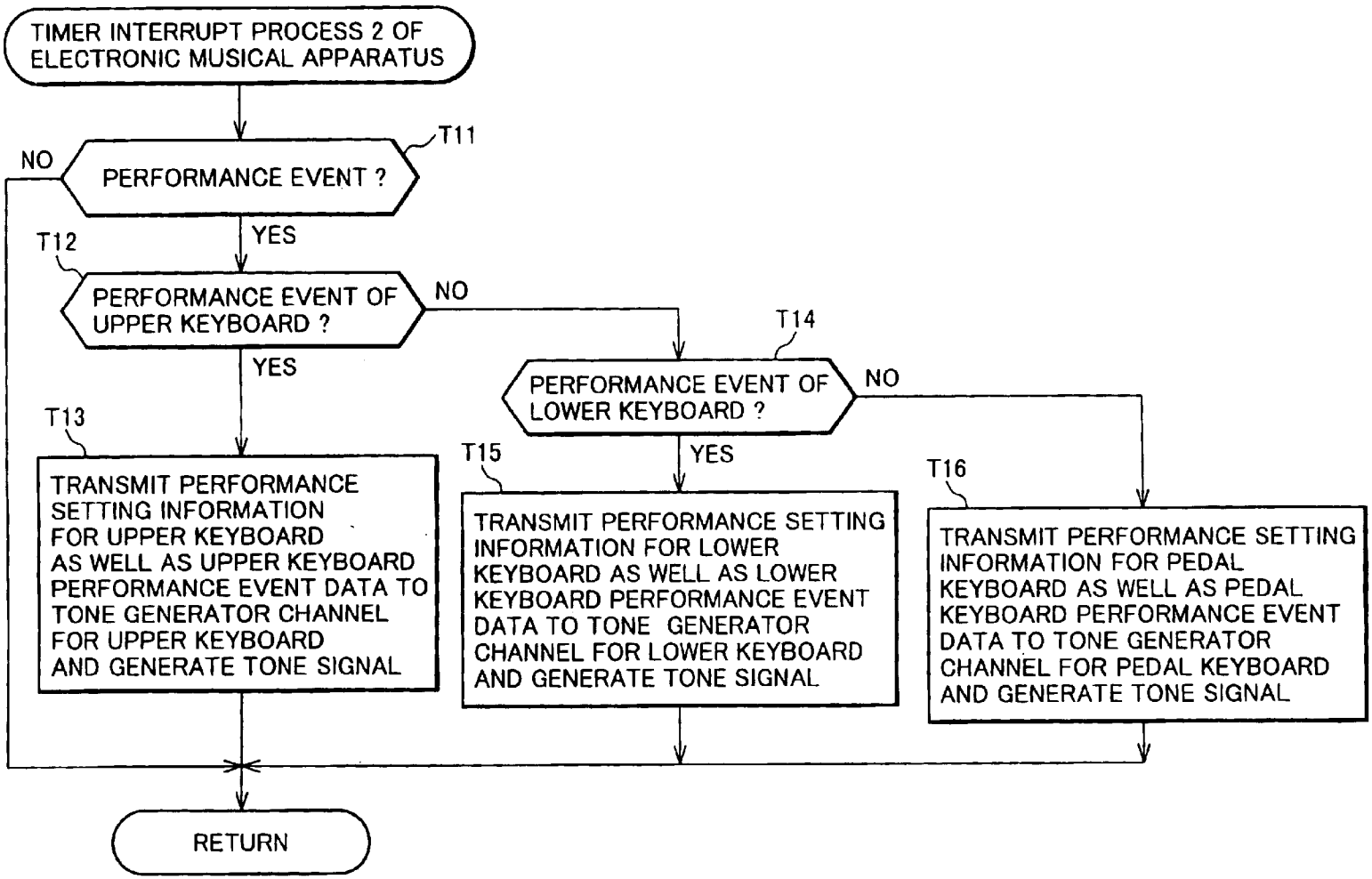
FIG. 9 is a flow chart illustrating a timer interrupt process (musical tone signal generation control process) to be executed by an electronic musical apparatus according to the embodiment.

An electronic musical apparatus timer interrupt process 2 shown in FIG. 9 is activated at a predetermined time interval if the conditions of the hot communication mode are in the "continuous mode". In this interrupt process, a musical tone signal generation control process is executed in response to a performance information which occurs by manual operation of the main performance operator of the performance operator unit 15, reading the automatic performance data from RAM 13 and the external storage device 14, or receiving external performance data from the second communication I/F 20.

In the flow chart shown in FIG. 9, it is checked at the first Step T11 whether there is a performance event. If the performance event is not detected, the timer interrupt process 2 is immediately terminated to return to the main process, whereas if the performance event is detected, the processes at Step T12 and following Steps are executed.

At Step T12 it is checked whether the detected performance event corresponds to a performance operation by the upper keyboard. If affirmative, at Step T13 the performance setting information corresponding to the upper keyboard as well as the detected upper keyboard performance event data is transmitted to a tone generator channel for the upper keyboard to execute a tone signal generation control process, thereafter terminate the timer interrupt process 2 and return to the main process.

If the performance event is not for the upper keyboard, the flow advances from Step T12 to Step T14 whereat it is checked whether the performance event is a performance operation of the lower keyboard. If affirmative, at Step T15 the performance setting information corresponding to the lower keyboard as well as the detected lower keyboard performance event data is transmitted to a tone generator channel for the lower keyboard to execute a tone signal generation control process, thereafter terminate the timer interrupt process 2 and return to the main process.

If the performance event detected at Step T11 is not for the lower keyboard, then the performance event is for the pedal keyboard. Therefore, the flow advances from Step T14 to Step T16 whereat the performance setting information corresponding to the pedal keyboard as well as the detected pedal keyboard performance event data is transmitted to a tone generator channel for the pedal keyboard to execute a tone signal generation control process, thereafter terminate the timer interrupt process 2 and return to the main process.

The process shown in FIG. 9 is applied to the electronic musical apparatus of the type having data such as "electronic musical instrument data 3" shown in FIG. 4B and the upper, lower and pedal keyboards each having different performance setting information. If an electronic musical apparatus is of the one-keyboard type having the data such as "electronic musical instrument data 6", the process Step T13 is executed immediately after Step T11 (YES).

Figure 10:
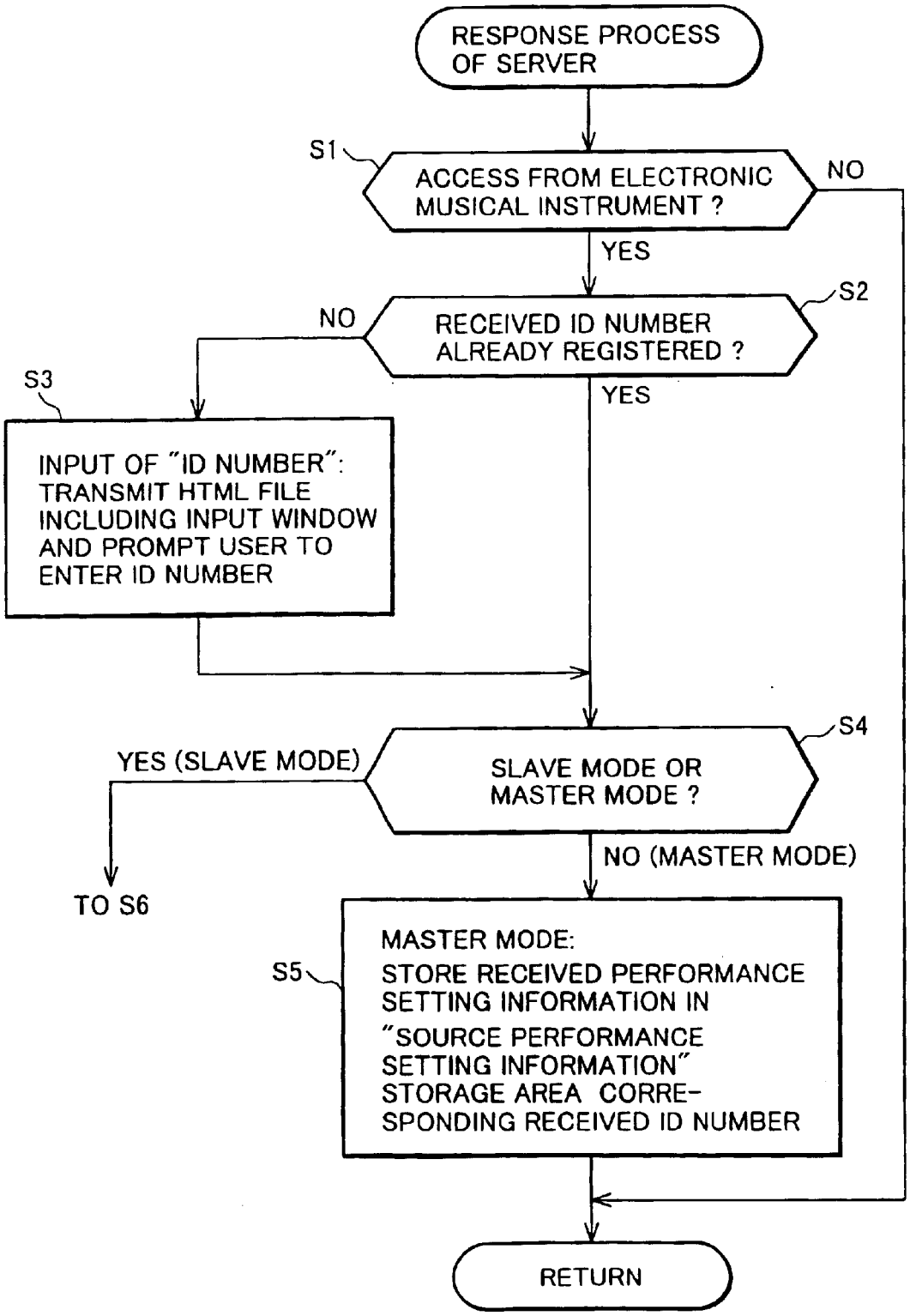
FIGS. 10 and 11 are a flow chart illustrating a response process to be executed by the server according to the embodiment.
Figure 11:
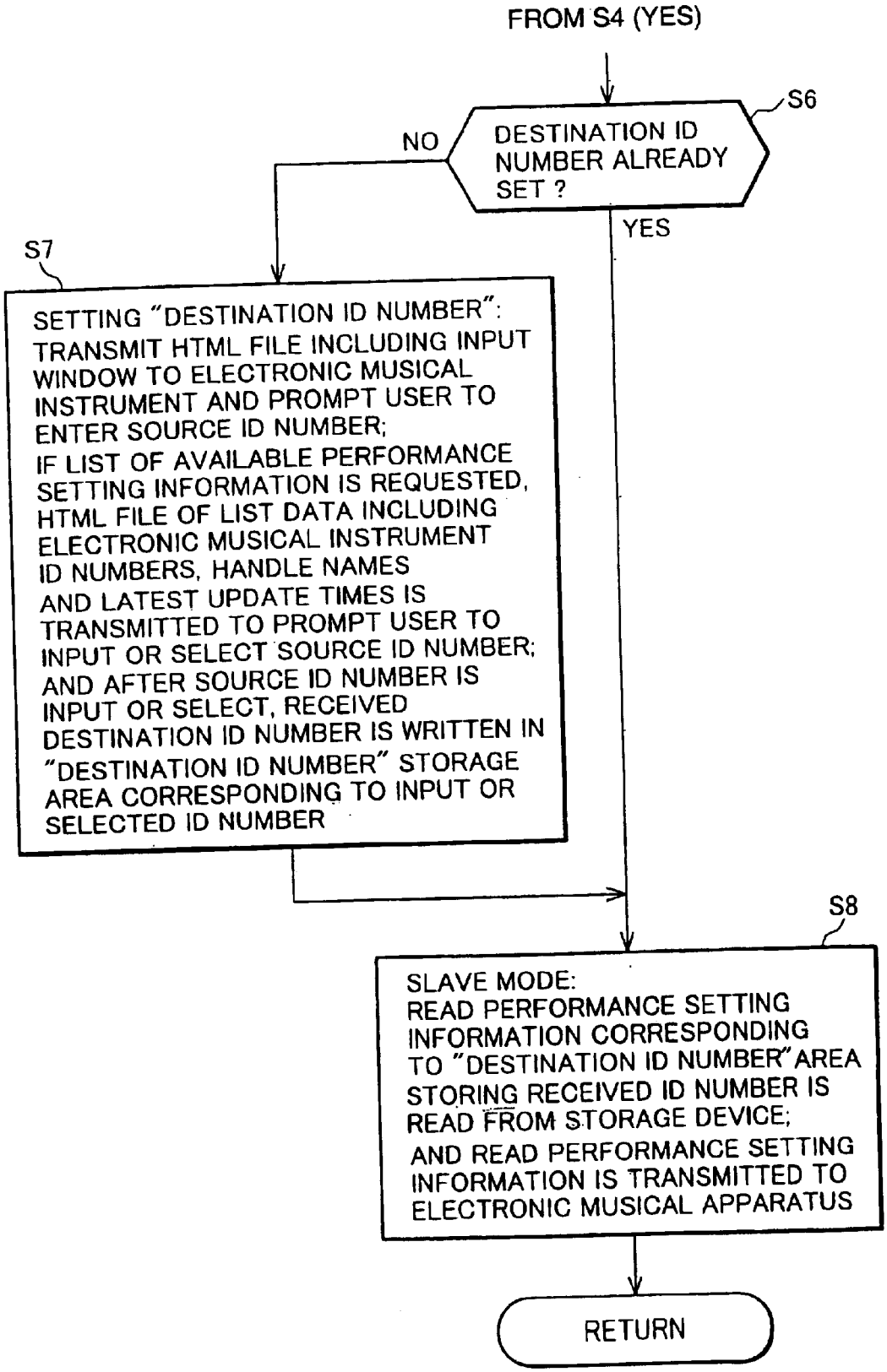

FIGS. 10 and 11 are a flow chart illustrating the response operation to be executed by the server according to the embodiment. This response process is activated during the main process of the server when there is an access from an electronic musical apparatus, e.g., at Step P7 (FIG. 7) or Step T3 (FIG. 8). At the first Step S1 it is checked whether there is an access from an electronic musical apparatus such as an electronic musical instrument. If not, the response process is immediately terminated to return to the main process, whereas if an access is detected, the flow advances to Step S2.

At Step S2 by referring to the information of the electronic musical instrument transmitted at Step P9 or P10 (FIG. 7) or at Step T5 or T6 (FIG. 8), it is checked whether the ID number received from the electronic musical apparatus is already registered. If not registered, the ID number of the electronic musical instrument is input at Step S3. In order to make the user input the ID number, an HTML file including an input window is transmitted to the electronic musical apparatus to make the user input the ID number.

If it is confirmed at Step S2 that the received ID number is already registered (YES) or if the ID number is input at Step S3, then at Step S4 it is checked from the received information whether the present mode is the slave mode or master mode. If the present mode is the master mode (NO), the process for the master mode is executed at Step S5. Namely, the received performance setting information is stored in a "source performance setting information" storage area corresponding to the received ID number. After this master mode process is executed, the response process is terminated to thereafter return to the main process.

If it is judged at Step S4 that the present mode is the slave mode (YES), the flow advances to Step S6 (FIG. 11) whereat it is checked whether the "destination ID number" is already set, i.e., it is checked whether the ID number of the accessing electronic musical apparatus is already set as the "destination ID number" for the ID number of the electronic musical apparatus which transmitted the performance setting information desired by the accessing electronic musical apparatus. If this setting is not already completed (NO), after the "destination ID number" is set at Step S7, the flow advances to Step S8. If this setting is already set (YES), the flow advances directly to Step S8.

In setting the "destination ID number" at Step S7, an HTML file including an input window is transmitted to the electronic musical apparatus such as an electronic musical instrument, and the user of the electronic musical apparatus is prompted to enter the ID number of the source electronic musical apparatus on the input window. In this case, the electronic musical apparatus can request for a list of available performance setting information. If the list of available performance setting information is requested, the server-transmits an HTML file including performance setting information data to the electronic musical apparatus. The performance setting information contains also electronic musical apparatus ID numbers, handle names, and the latest update times. The user is prompted to enter or select the electronic musical apparatus ID number of the transmission source of desired performance setting information. After the source ID number is input or selected, the received ID number of the destination electronic musical apparatus is stored in the "destination ID number" area corresponding to the input or selected ID number.

At Step S8 a slave mode process is executed. Namely, the source performance setting information corresponding to the "destination ID number" area storing the received ID number is read from the storage device 34. The read performance setting information is transmitted to the electronic musical apparatus such as an electronic musical instrument. After the slave mode process is executed, the response process is terminated to return to the main process.

In the above-described embodiment, performance setting information is transferred via the server. Instead, the performance setting information may be transferred directly (without involvement of the server) between two electronic musical apparatuses such as electronic musical instruments in a P to P mode using IP addresses. In this case, the setting of the hot communication mode at Step P5 (FIG. 6) uses new items (6) a direct data transfer (P to P) mode, (7) ID number or numbers of destination electronic musical apparatus or apparatuses, and (8) IP addresses. This P to P mode will be described below.

In this embodiment, the source ID number and IP address are stored in the server for the slave mode. If data is directly transferred, it is necessary for the electronic musical apparatus on the slave side to store the source ID number and IP address. Therefore, in the setting of the "hot communication mode" at Step P5 (FIG. 5), the direct data transfer (P to P) mode is set, and the source ID number and IP address are set. If the direct data transfer (P to P) mode is set, the source electronic apparatus is directly accessed by using the source IP address without involving the server.

In this case, the source electronic musical apparatus sets the IP addresses and ID numbers of electronic musical apparatuses from which accesses are permitted. When there is an access from an electronic musical apparatus whose IP address and ID number have already been set, the stored performance setting information is read and transmitted irrespective of whether the mode is the master or slave mode.

In order to establish communication states of electronic musical apparatuses between which performance setting information is transferred, the system is required to have functions such as apparatus verification, use permission level, and apparatus function matching. For example, for the apparatus verification, the server checks special number trains corresponding to product numbers. For the use permission level, a hot communication level, write permission/inhibition, use apparatus range and the like are determined. For the apparatus matching, an apparatus matching level between two apparatuses is determined from an apparatus matching table. Such information is notified to users. Such functions are required to be provided to each electronic musical apparatus, particularly in the P to P mode.

The present invention has been described in connection with the preferred embodiments. The invention is not limited only to the above embodiments. It is apparent that various modifications, improvements, combinations, and the like can be made by those skilled in the art.

What we claim are:

1. An electronic musical apparatus having an interface for connecting to a communication network, comprising:

a memory;

a transmitter that transmits, to a server on the communication network via the interface, a performance setting information used for executing musical performance in accordance with a first performance information on the electronic musical apparatus so as to store the performance setting information in the server;

a receiver that receives, from the server on the communication network via the interface, the performance setting information stored in the server;

a controller that controls the received performance setting information to store into the memory;

an input device that inputs a second performance information; and a musical tone generator that generates a musical tone in accordance with the second performance information and the stored performance setting information.

2. An electronic musical apparatus according to claim 1, wherein the second performance information is input by manual operation or by reading from the memory.

3. An electronic musical apparatus according to claim 1, wherein the receiver receives the performance setting information by accessing to a server on the communication network via the interface.

4. An electronic musical apparatus according to claim 1, wherein the receiver receives the performance setting information at a predetermined interval.

5. An electronic musical apparatus according to claim 1, further comprising:

a setting device that sets, in accordance with a manual operation, an another performance setting information set for executing musical performance; and a transmitter that transmits the another performance setting information set by the setting device to the server on the communication network via the interface.

6. An electronic musical apparatus according to claim 1, wherein the performance setting information is a control parameter for controlling at least one of tone color, touch response, volume, tempo, pan, automatic accompaniment, and effect, which are related to the musical tone generated by the musical tone generator.

7. An electronic musical apparatus according to claim 6, wherein the electronic musical apparatus or other electronic musical apparatus is an electronic keyboard instrument having musical keyboard and an operation panel with an operator, and the control parameter is set by the operator on the operation panel.

8. An electronic musical apparatus according to claim 1, further comprising a selector that selects either one of a master mode in which the electronic musical apparatus transmits information and a slave mode in which the electronic musical apparatus receives information, wherein the receiver receives the performance setting information when the slave mode is selected by the selector.

9. An electronic musical apparatus according to claim 1, further comprising an operator that directs the electronic musical apparatus to make a connection with the communication network and makes the electronic musical apparatus ready for receiving the performance selling information from the communication network.

10. An electronic musical apparatus according to claim 9, wherein the operator comprises a switch on an operation panel.

11. An electronic musical apparatus according to claim 9, wherein the operator comprises a detecting circuit that detects an operation.

12. A server connecting to a plurality of electronic musical apparatuses via a communication network, each electronic musical apparatus generating a musical tone in accordance with performance information and performance setting information set for executing musical performance and having an ID information, the server comprising:

a memory that stores the performance setting information transmitted from the plurality of electronic musical apparatuses together with the ID information corresponding to the performance setting information;

a receiver that receives a request for the performance setting information corresponding to a specified ID information from one electronic musical apparatus; and a replying device that reads, in response to the request, the performance setting information corresponding to the specified ID information from the memory and replies the read performance setting information to said one electronic musical apparatus.

13. A server according to claim 12, wherein the request for the performance setting information transmitted from said one electronic musical apparatus is selected from a list, received from the sever, of performance setting information that is available for said one electronic musical apparatus.

14. A server according to claim 12, wherein the performance setting information is a control parameter for controlling at least one of tone color, touch response, volume, tempo, pan, automatic accompaniment, and effect, which are related to the musical tone generated by the musical tone generator.

15. An electronic keyboard instrument having an interface for connecting to a public communication network, comprising:

a memory that stores performance setting information set for executing a musical performance;

a setting operator that controls the stored performance setting information by a manual operation;

a musical keyboard;

an input device that inputs performance information by playing the musical keyboard;

a musical tone generator that generates a musical tone in accordance with the input performance information and the stored performance setting information; and a transmitter that transmits the performance setting information stored in the memory and ID information of the electronic musical instrument to a server on the public communication network via the interface to make the server store the transmitted performance setting information on a predetermined storage area corresponding to the ID information, thereby the performance setting information stored in the server can be received by the electronic keyboard instrument or other electronic musical apparatus by connecting to the public communication network.

16. An electronic musical apparatus according to claim 15, further comprising a selector that selects either one of a master mode in which the electronic musical apparatus transmits information and a slave mode in which the electronic musical apparatus receives information, wherein the transmitter transmits the performance setting information when the master mode is selected by the selector.

17. An electronic musical apparatus according to claim 15, further comprising a communication amount setting device that sets a communication amount of the performance setting information to be transmitted, wherein the transmitter transmits the performance setting information in accordance with the communication amount of the performance setting information to be transmitted set by the communication amount setting device.

18. A performance setting information processing method performed by an electronic musical apparatus having an interface for connecting to a communication network, the method comprising the steps of:

(a) transmitting, to a server on the communication network via the interface, a performance setting information used for executing musical performance in accordance with a first performance information on the electronic musical apparatus so as to store the performance setting information in the server;

(b) receiving, from the server on the communication network via the interface, the performance setting information stored in the server;

(c) controlling the received performance setting information to store into a memory;

(d) inputting a second performance information; and (e) generating a musical tone in accordance with the second performance information and the stored performance setting information.

19. An information processing method performed by a server connecting to a plurality of electronic musical apparatuses via a communication network, each electronic musical apparatus generating a musical tone in accordance with performance information and performance setting information set for executing musical performance and having an ID information, the method comprising the steps of:

(a) storing the performance setting information transmitted from the plurality of electronic musical apparatuses together with the ID information corresponding to the performance setting information into a memory;

(b) receiving a request for the performance setting information corresponding to a specified ID information from one electronic musical apparatus;

(c) reading, in response to the request, the performance setting information corresponding to the specified ID information from the memory; and (d) replying the read performance setting information to said one electronic musical apparatus.

20. A program embodied in a computer-readable medium, which a computer executes to realize a performance setting information process for an electronic musical apparatus having an interface for connecting to a communication network, comprising the instructions of:

(a) transmitting, to a server on the communication network via the interface, a performance setting information used for executing musical performance in accordance with a first performance information on the electronic musical apparatus so as to store the performance setting information in the server;

(b) receiving, from the server on the communication network via the interface, the performance setting information stored in the server;

(c) controlling the received performance setting information to store into a memory;

(d) inputting a second performance information; and (e) generating a musical tone in accordance with the second performance information and the stored performance setting information.

21. A program embodied in a computer-readable medium, which a computer executes to realize an information process for a server connecting to a plurality of electronic musical apparatuses via a communication network, each electronic musical apparatus generating a musical tone in accordance with performance information and performance setting information set for executing musical performance and having an ID information, comprising the instructions of:

(a) storing the performance setting information transmitted from the plurality of electronic musical apparatuses together with the ID information corresponding to the performance setting information into a memory;

(b) receiving a request for the performance setting information corresponding to a specified ID information from one electronic musical apparatus;

(c) reading, in response to the request, the performance setting information corresponding to the specified ID information from the memory; and (d) replying the read performance setting information to said one electronic musical apparatus.

22. A performance setting information processing method performed by an electronic musical apparatus having an interface for connecting to a communication network, the method comprising the steps of:

(a) controlling performance setting information stored in a memory by a manual operation;

(b) inputting performance information by playing a musical keyboard;

(c) generating a musical tone in accordance with the input performance information and the stored performance setting information; and (d) transmitting the performance setting information stored in the memory and ID information of the electronic musical instrument to a server on the public communication network via the interface to make the server store the transmitted performance setting information on a predetermined storage area corresponding to the ID information, thereby the performance setting information stored in the server can be received by the electronic keyboard instrument or other electronic musical apparatus by connecting to the public communication network.

23. A program embodied in a computer-readable medium, which a computer executes to realize performance setting information process for an electronic musical apparatus having an interface for connecting to a communication network, comprising the instructions of:

(a) controlling performance setting information stored in a memory by a manual operation;

(b) inputting performance information by playing a musical keyboard;

(c) generating a musical tone in accordance with the input performance information and the stored performance selling information; and (d) transmitting the performance setting information stored in the memory and ID information of the electronic musical instrument to a server on the public communication network via the interface to make the server store the transmitted performance setting information on a predetermined storage area corresponding to the ID information, thereby the performance setting information stored in the server can be received by the electronic keyboard instrument or other electronic musical apparatus by connecting to the public communication network.

* * * * *

UNITED STATES PATENT AND TRADEMARK OFFICE

CERTIFICATE OF CORRECTION

PATENT NO. : 7,189,911 B2
APPLICATION NO. : 10/171110
DATED : March 13, 2007
INVENTOR(S) : Yoshimasa Isozaki It is certified that error appears in the above-identified patent and that said Letters Patent is hereby corrected as shown below:

Col. 15, Line 60, Claim 9:
"selling" should be --setting--

Col. 18, Line 54, Claim 23:
"selling" should be --setting--

Signed and Sealed this

Twenty-fourth Day of July, 2007

JON W. DUDAS
*Director of the United States Patent and Trademark Office*